US005514028A

United States Patent [19]

Ali et al.

[11] Patent Number: 5,514,028

[45] Date of Patent: May 7, 1996

[54] SINGLE SHEET SANDPAPER DELIVERY SYSTEM AND SANDPAPER SHEET THEREFOR

[76] Inventors: Christopher A. Ali, 2109 Beaver Valley Rd., Beavercreek, Ohio 45385; Terry L. Ali, 2645 Pheasant Run La., Beavercreek, Ohio 45434; Ralf Karlstrom, Nedranvägen 25, FIN-66840 Pensala, Finland

[21] Appl. No.: 178,774

[22] Filed: Jan. 7, 1994

[51] Int. Cl.[6] ..... B24D 11/00

[52] U.S. Cl. ..... 451/539; 451/526; 451/527

[58] Field of Search ..... 451/526, 527, 451/539

[56] References Cited

U.S. PATENT DOCUMENTS

| | | | |
|---|---|---|---|
| 3,607,348 | 9/1971 | Wray et al. | 117/38 |
| 4,095,961 | 6/1978 | Wirth | 451/28 |
| 4,239,501 | 12/1980 | Wirth | 451/28 |
| 4,606,154 | 8/1986 | Herrmann et al. | 451/526 |
| 4,858,907 | 8/1989 | Eisner et al. | 271/124 |
| 5,084,354 | 1/1992 | Krankkala et al. | 428/414 |
| 5,184,900 | 2/1993 | Eisner et al. | 400/82 |
| 5,326,181 | 7/1994 | Eisner et al. | 400/104 |

*Primary Examiner*—Bruce M. Kisliuk
*Assistant Examiner*—Derris Banks
*Attorney, Agent, or Firm*—R. William Graham

[57] ABSTRACT

The present invention is directed to a single sheet sandpaper delivery system which includes at least one stackable tray having a support surface, with at least two sides, wherein one of each said sides is connected an opposing edge portion of the support surface and extends generally normal thereto, and wherein the support surface has an edge portion laterally spacing the sides. The present invention further includes at least one sandpaper package having housing portion of a size and configuration slightly less than the support surface of the tray, at least two flap portions of a predetermined length and width which are bendably connected to the housing portion, and at least two second flaps, one of each of the second flaps bendably connected to the first flaps and foldable to connect to one another and form the package, and further including a novel sandpaper sheet having a first side of sufficient porosity to maintain a coat of adhesive material and a second side sufficiently nonporous to accept a printed ink bar code with minimal diffusion to provide an overall improved and readable bar code.

6 Claims, 9 Drawing Sheets

SINGLE SHEET SANDPAPER DELIVERY SYSTEM AND SANDPAPER SHEET THEREFOR

BACKGROUND OF THE INVENTION

The present invention relates to a single sheet sandpaper delivery system and single sheet sandpaper therefor.

The present sandpaper delivery systems suffer from several problems including, but not limited to, inefficiency and lack of desirability in the market place. Presently, there does not exist a system for delivering single sheet sandpaper for today's market. This is due to problems associated with curling of sandpaper and the inability of producing an acceptable an readable Universal Product Code (UPC) on the sandpaper. Thus, multiple sandpaper sheets are packaged in a single paper container which have the UPC marking thereon. Moreover, the sandpaper sheets are packaged in a manner such that the packages are hung in a vertical manner from a peg board or like for viewing and identification, taking up large amount of showroom square footage within a store.

Usually, multiple sheets of a particular grit size are sold in a package. The consumer, however, typically does not require multiple sheets of a particular grit size. Rather, it is preferred to be able to select only the number and type of sandpaper sheets necessary to perform a particular job.

In order selectively buy and sell sandpaper in the present supermarket industry and general merchandise community, a UPC is needed on each sheet of sandpaper and a means for preventing the sandpaper from curling on the shelf. Commercially available sandpaper lends itself poorly to receiving a UPC bar code thereon which would meet minimum tolerances, reflectivity and contrast requirements, as well as, character clarity to provide a consistent overall readable code. Furthermore, sandpaper inherently tends to curl due to present sandpaper construction, which contains adhesive and grits causing curling to the paper.

The present invention seeks to overcome the problems associated with the prior art in providing a novel single sheet sandpaper delivery system and single sandpaper sheet therefor.

SUMMARY OF INVENTION

It is an object of the present invention to provide a new and improved single sheet sandpaper delivery system.

It is a further object of the present invention to provide a novel single sheet sandpaper article of manufacture which has a highly acceptable and readable UPC.

It is a further object of the present invention to provide a novel process for making high quality sandpaper which can have printed thereon a UPC code.

It is still another object of the present invention to provide a novel package for multiple sheet sandpaper which retards curling of the paper while housed therein and further provides single sheet delivery.

It is still another object of the present invention to provide a stackable tray for use with the single sheet sandpaper delivery system of the present invention.

Accordingly, the present invention is directed to a single sheet sandpaper delivery system, comprising at least one stackable tray having a support surface, at least two sides, wherein one of each of the sides is connected an opposing edge portion of the support surface and extends generally normal thereto, and wherein the support surface has an edge portion laterally spacing the sides. The system further includes at least one sandpaper package having housing portion of a size and configuration slightly less than the support surface, the portion having at least two first flap portions of a predetermined length of between about ⅛" to ⅝" connected to opposing edge portions of the housing portion, and wherein each the first flap portion has bendably connected thereto a second flap portion of a length and configuration such that when the first flap portions are bent in a common direction generally normal to the housing surface portion, the second flap portions are bent inwardly toward one another in a generally parallel to a plane formed by said main portion, the second flap portions being interconnectable to one another to form the package, the housing portion further including zipper perforations which extend radially inwardly a predetermined distance from one of the edges of the housing portion and terminate in a common opening defined in the housing portion. In addition, the system has a plurality of sandpaper sheets disposed in the package.

In the preferred embodiment, the system is directed to a single sheet sandpaper delivery system, comprising a stackable tray having a support surface, a first side connected to a first edge of the support surface extending generally normal thereto, a second side connected to a second edge of the support surface extending generally normal thereto, and a third edge connecting the first edge and said second edge wherein an opening is defined between the sides. The system further includes at least one sandpaper package having a first housing portion of a size and configuration slightly less than the support surface of tray, the first housing portion having at least three edges, wherein each edge has a first flap portion bendably connected thereto of a predetermined length of between about ⅛" to ⅝" and wherein each of the first flap portions has bendably connected thereto a second flap portion of a length and configuration such that when the first flap portions are bent in common direction generally normal to the first housing portion, the second flap portions are bendable inwardly toward one another generally parallel to the first housing portion, and the second flap portions are interconnectable to one another to form a housing of the package. The first housing portion includes zipper perforations which extend diagonally inwardly a predetermined distance from corners common to one of the first housing portion's edge and terminates in a common opening defined in the first housing portion. The package includes a plurality of single sandpaper sheets disposed therein. The single sandpaper sheet of the present invention are further characterized such that each has a substrate having a first side of sufficient porosity to readily accept and maintain a coat of adhesive material and a second side sufficiently nonporous to accept a printed ink bar code with minimal diffusion to provide an overall improved and acceptable scan analysis profile; a base adhesive coat substantially covering and penetrating the first side of the substrate; an abrasive grit material dispersed over and bonded to the base adhesive cost and the first side; and an ink printed bar code on the second side of said substrate, wherein the ink is of a high solids content and high dry weight.

DETAILED DESCRIPTION OF THE DRAWINGS

Figure 1:
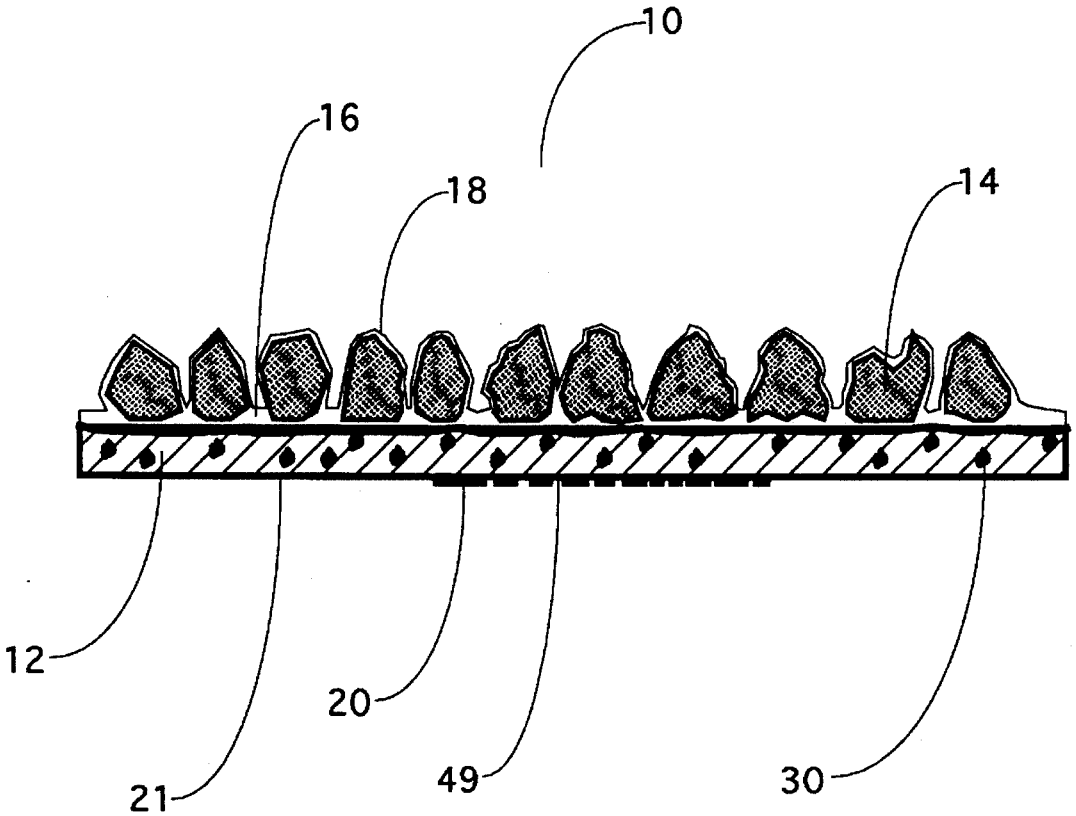
FIG. 1 is a cross-sectional representation of a sandpaper sheet of the present invention.

Referring to the drawings, the present invention is depicted in the figures thereof. FIG. 1. shows a cross-section of a single sandpaper sheet 10 which is believed unique and novel for use with the present invention. The sheet 10 includes a paper substrate 12, grit 14, base adhesive coat 16, resin sizing adhesive coat 18, and printed bar code 20. As stated, sheet 10 includes the paper substrate 12 which has been surfaced at least on one side 21 to close porosity thereof and can be densified with an opacifier or filler 30 such as titanium dioxide. It is noted and is of particular importance in the abrasive paper industry that the paper substrate 12 be chosen of a grade, porosity and fiber to achieve a cost efficient substrate highly suitable for forming sandpaper. For example, the substrate 12 should be of a fiber strength and porosity to readily adhere and maintain the grit 14 on the surface thereof while providing flexibility.

However, these desired properties of sandpaper conflicted with applying a readable bar code on existing sandpaper. In addition to porosity and fiber choice of the substrate, color of the grit interferes with the readability of a bar code on sandpaper.

Figure 2:
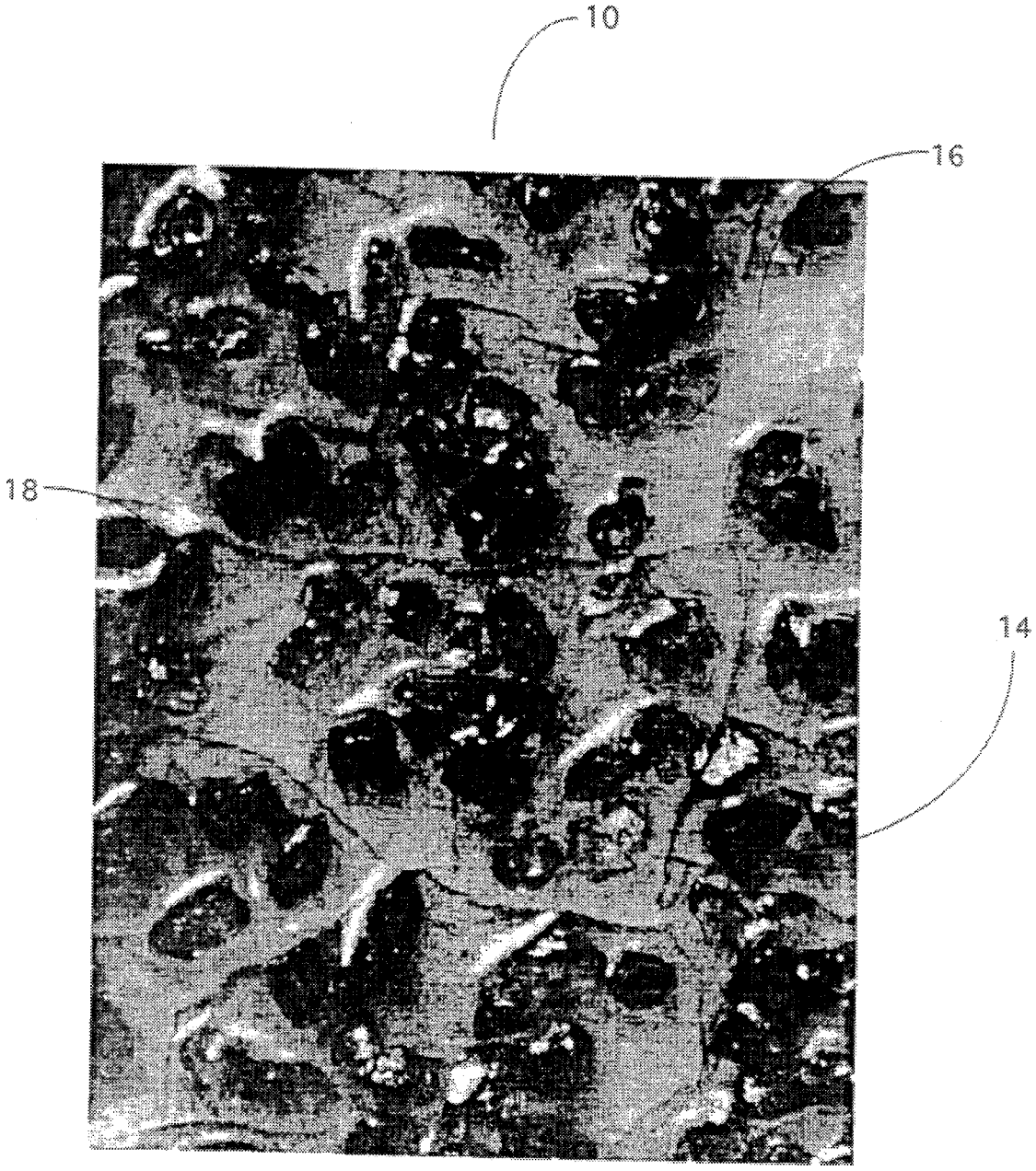
FIG. 2 is a magnified photographic view of a grit/adhesive covered surface of a piece of sandpaper.
Figure 3:
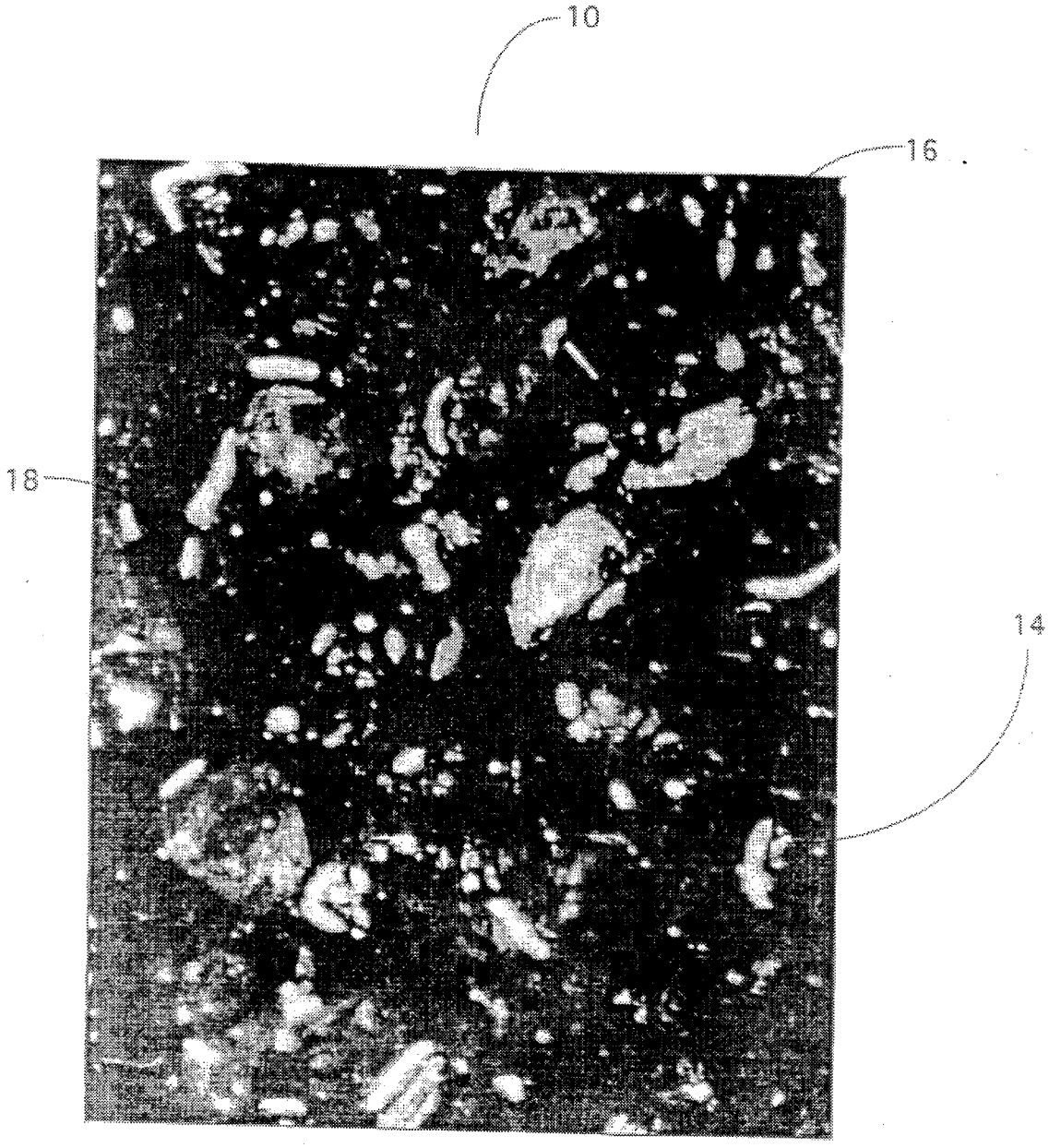
FIG. 3 is another magnified photographic view of a grit/adhesive covered surface of a piece of waterproof sandpaper.

The adhesive base resins, grits and fibers used in the sandpaper industry tends to be dark, especially in the case of wet sandpaper which is essentially black or dark grey. FIG. 2 and 3 best illustrate this point.

FIG. 2 is a magnified photographic view of the surface of the sandpaper sheet 10 of the present invention, for example, having grit 14, adhesive 16 and resin sizing coat 18 thereon. FIG. 3, similarly, is a magnified photographic view of a side of waterproof sandpaper having grit, adhesive and resin sizing thereon. Both FIGS. 2 and 3 depict the darkness of the grit utilized on the substrate. This grit's darkness has a tendency to show through to the substrate side on which the bar code is printed. This negatively effects the contrast and in turn the readability of the bar code. Heretofore, no suitable substrate could provide readable bar code sandpaper.

In order for a high quality bar code readable substrate to be achieved, the substrate must be such that it enables high modulation, decodability and contrast and minimum reflection or defects.

The substrate 12, thus had to be modified in order to develop contrast between adjacent printed ink bars, contrast between light (non-inked substrate) and dark (inked substrate) sections, and minimizing of defects while retaining desired properties for a high quality sandpaper.

Figure 4A:
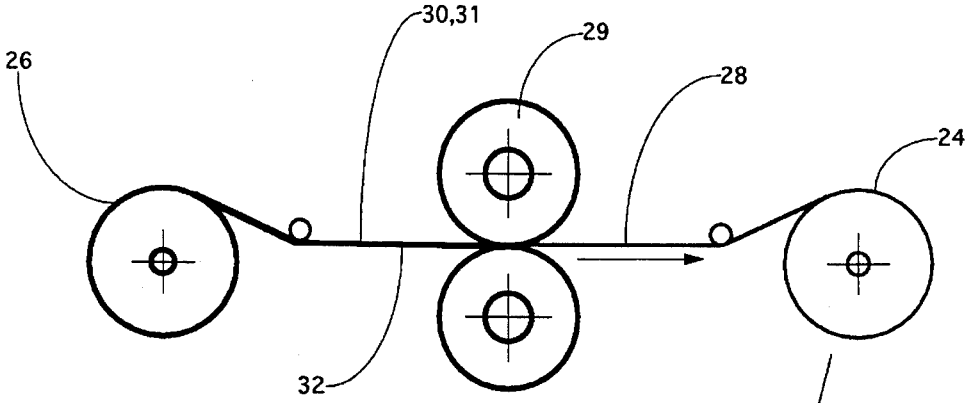
FIG. 4 is a depiction of the process for making the sandpaper of the present invention.
Figure 4:
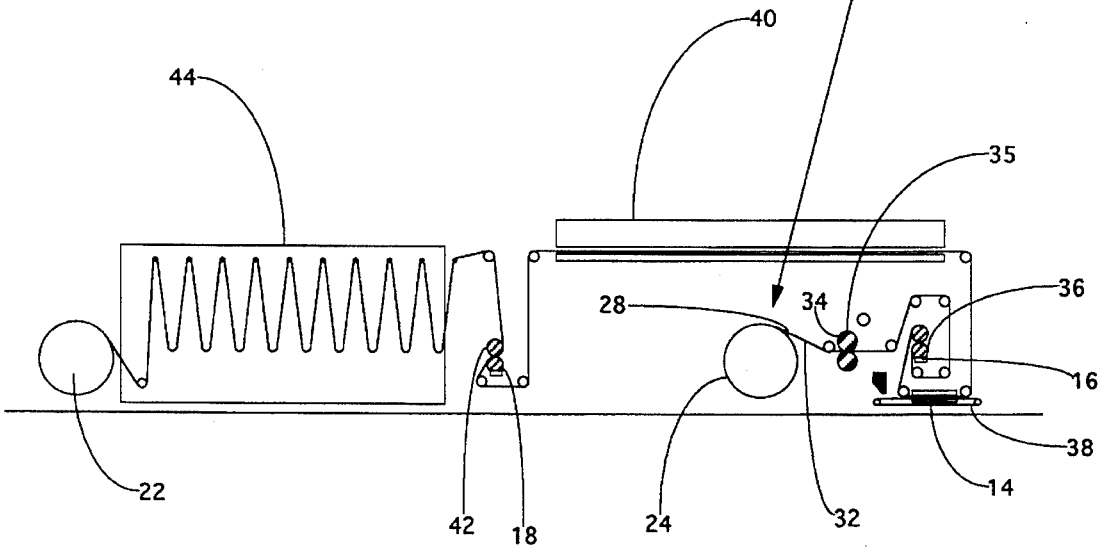

In this regard, referring to FIG. 4, the process of forming a single sandpaper sheet web 22 to be used to form single sandpaper sheets 10 is illustrated. A web 24 was formed by super calendering a web 26 of upper grade cabinet paper at least on side 28 using drums 29 to provide a printing surface smoothness of from about 200–300 ml/min Bendtsen (SCAN-P 21:67). The amount of calendaring should be such that it does not close porosity on side 32 to such a degree that adherence of adhesive 16 and grit 14 are hindered.

Also, the web 26 is preferably bleached to achieve sufficient contour and contrast upon printing. Bleaching is done prior to formation of the web 24 in a conventional manner as is known in the art.

An opaque filler 30, such as titanium dioxide, can be employed prior to calendaring to achieve higher pore closure on side 28. Optionally, the opaque filler 30 can be intermixed with part of an adhesive 31 to prevent the color of the dark grain or grit from inhibiting readability of the bar coding. However, the amount of filler 30 and calendering should not be so great to cause pore closure on a side 32 of the web to which the base adhesive coat 16 is applied. Too much filler results in drawbacks such as weakening and increasing cost of the sand paper.

Web 24 is passed through a flexo-printing station 34 wherein a bar code is ink printed onto side 28. Printing plates 35 are designed of a size and configuration to print a bar code on the side 28 in an arrangement and spacing in accordance with a predetermined single sheet 10 size and configuration. Plates 35 are preferably reduced about 4% to 6% in order to aid in achieving a proper printed image which conforms to UPC requirements.

Inks used in the present invention are high dry weight with high solids ink content approaching 100%. Solvents, such as, glycols, glycol ethers, pyrolidines, etc. may be employed as part of the ink content. High dry weight and high solids content attribute to a readable bar code.

The web 24 is passed through a base adhesive coating station 36, wherein the other side 32 of web 24 is coated with the base coat 16. While the adhesive 16 is wet, the web 24 is passed through an electrostatic coater 38 which oppositely charges the web 24 and grit 14 to draw the grit 14 into contact with side 32 of the web 24.

The web 24 passes through an oven 40 which cures the base coat 16 to secure the grit 14 to the web 25. Upon exiting from the oven 40, the side 32, grit 14 and base coat 16 pass by a second adhesive coating station 42 wherein a sizing coat of resin 18 is applied thereto. The web 24 is then passed through a festoon drying oven 44 for curing, where upon exiting oven 44, the finished web 22 is formed. The web 22 is then cut in accordance in predetermined sizes and shapes, i.e. square, circular or triangular.

Figure 5:
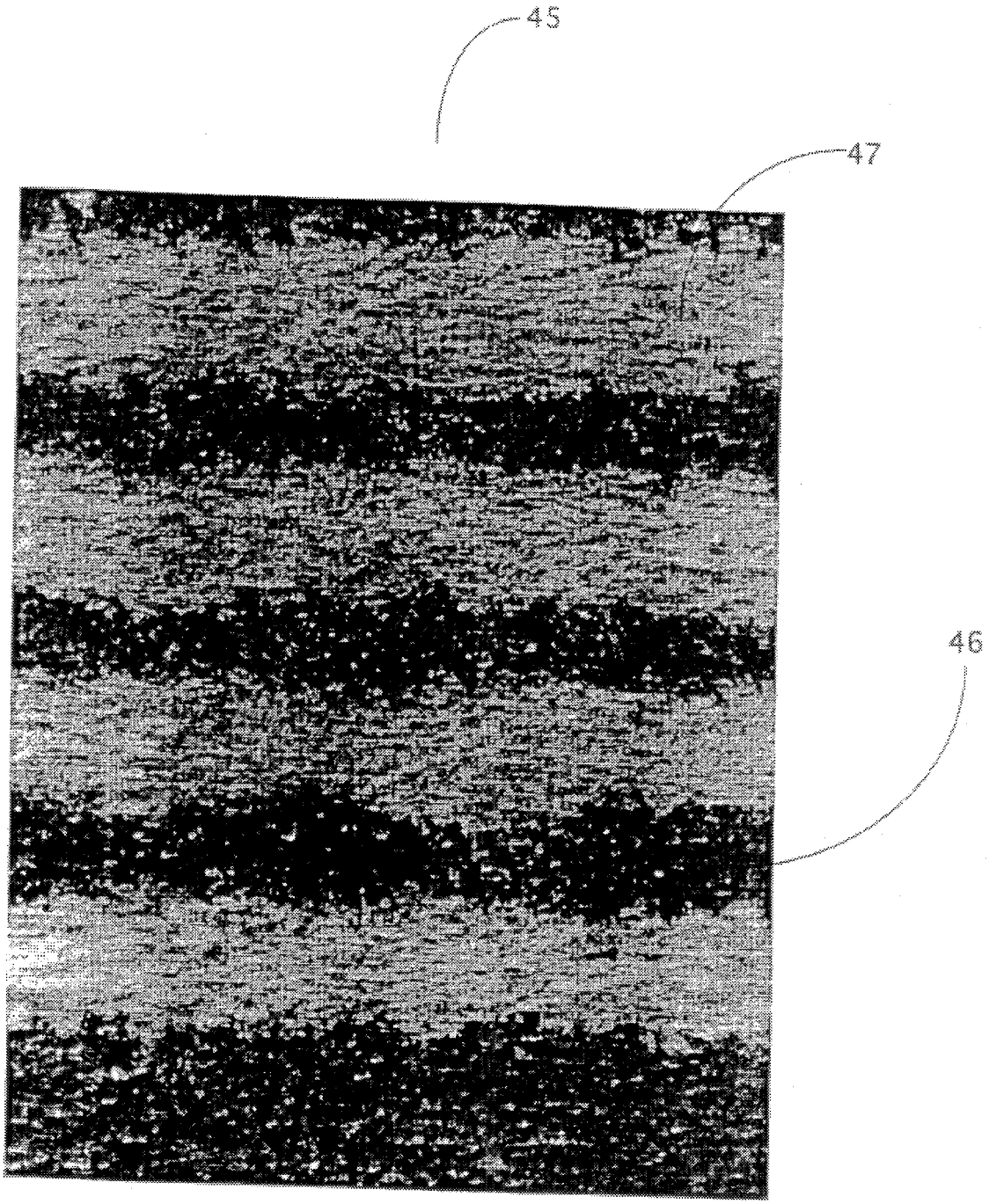
FIG. 5 is a magnified picture of the prior art sandpaper sheet backing having a bar code printed thereon.

FIG. 5 shows a magnified photographic picture of the prior art backing of a single sheet sandpaper 45 with a printed bar coding 46 thereon. As can be seen from the picture in FIG. 3, edge contrast of bars and contrast between bars and non-bar inked sections 47 are relatively low grade.

Figure 6:
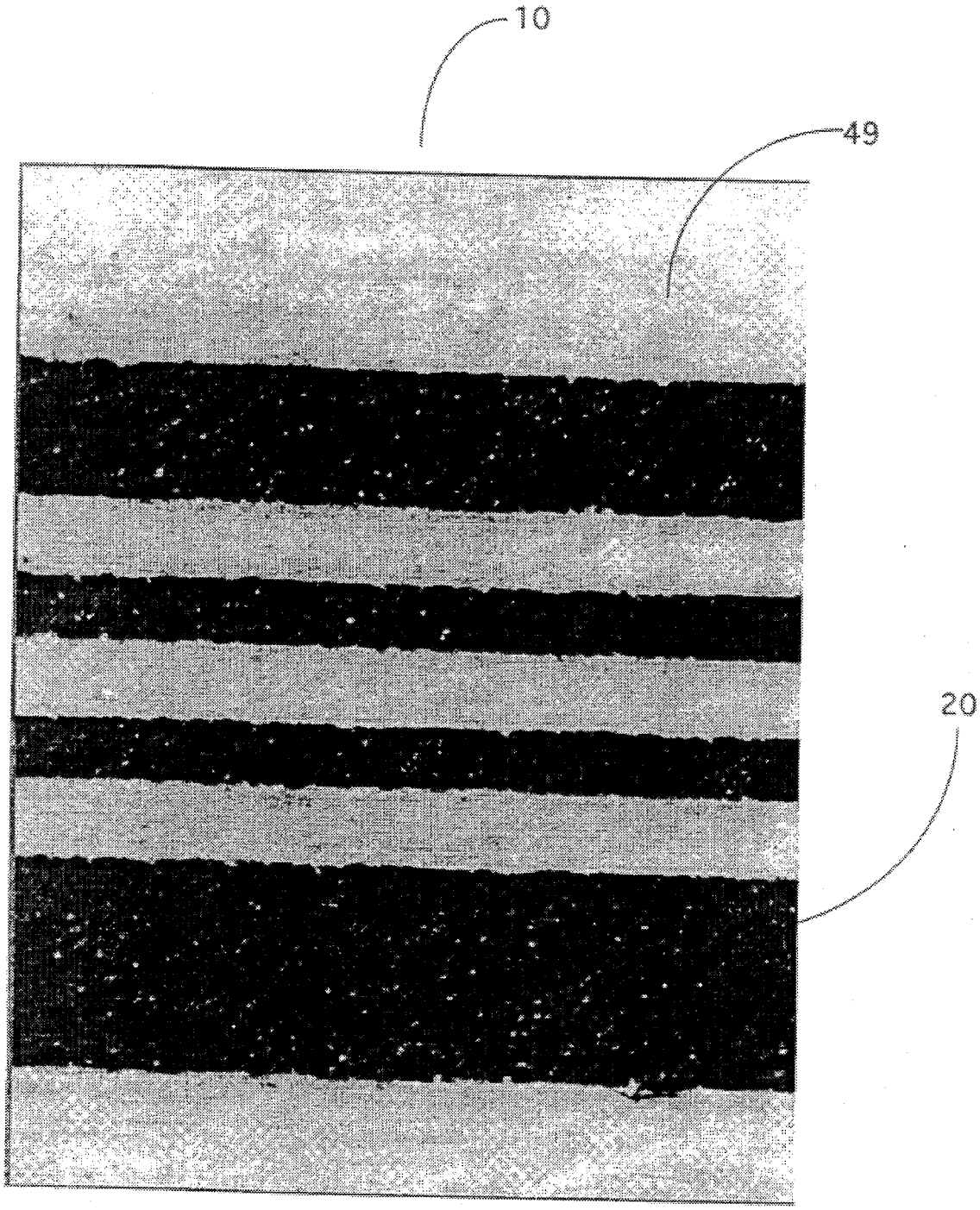
FIG. 6 is a magnified picture of the sandpaper sheet backing of the present invention having a bar code printed thereon.

FIG. 6 shows a magnified photographic picture of the backing of the single sheet sandpaper 10 of the present invention. As seen in FIG. 4, the backing of the sandpaper sheet 10 of the present invention provides for a bar coding with excellent edge contrast of bars 20 and contrast between bars 20 and non-bar inked sections 49.

Using an UPC wand scanner, the substrates shown in FIG. 5 and FIG. 6 were scanned for readability. Several scanning passes were made over each printed bar coded substrates. For example, scans were made transversely across the bar code in a perpendicular manner to the bar code lines, as well as diagonally across the bar codes. The results are shown below.

| Bar Code | Substrate of FIG. 5 Rating Scan Pass No. | | | Substrate of FIG. 6 Rating Scan Pass No. | | |
|---|---|---|---|---|---|---|
| Quality Criteria | 1 | 2 | 3 | 1 | 2 | 3 |
| Reference Decode | F | A | A | A | A | A |
| Decodability | F | C | A | A | A | A |
| Symbol Contrast | B | B | B | A | A | A |
| Reflection | A | A | A | A | A | A |
| Edge Contrast | A | A | A | A | A | A |
| Modulation | C | D | D | B | B | A |
| Defects | B | B | B | B | A | B |
| Application Compliance | A | A | A | A | A | A |
| Print Contrast Signal | 83% | 84% | 88% | 93% | 92% | 93% |
| Element Reflectance (MAX) | 65% | 79% | 54% | 81% | 81% | 80% |
| Reflectance (MIN) | 11% | 12% | 06% | 05% | 06% | 05% |
| Pass/Fail Analysis | Fail | Fail | Fail | Pass | Pass | Pass |

NOTE: The Bar Code Quality Criteria are standard criteria as is known in the art of verification of universal products codes. See, for example, Hardlines Industry Guideline on Bar Coding, American Hardware Manufacturing Association; incorporated herein by reference.

As can be seen from the scanning results, the readability of the bar code is shown in FIG. 6 consistently passed the analysis of the scanner whereas the readability of the bar code of FIG. 5 consistently failed the scanner analysis.

Though inconsistent readable bar code sandpaper existed, such as that shown in FIG. 5, there still was a lack of incentive to explore providing a more readable bar code application because of the above discussed problems and further because no adequate single sheet delivery system existed in which to keep sandpaper from curling.

Curling is due to resin sizing which restricts expansion or contraction of the side of the sandpaper to which it is adhered. Higher quality resin sandpaper curls more because the resin of waterproof paper, for example, repels more water than the non-coated side and more moisture is drawn to the non-coated side causing expansion and curling.

Figure 7:
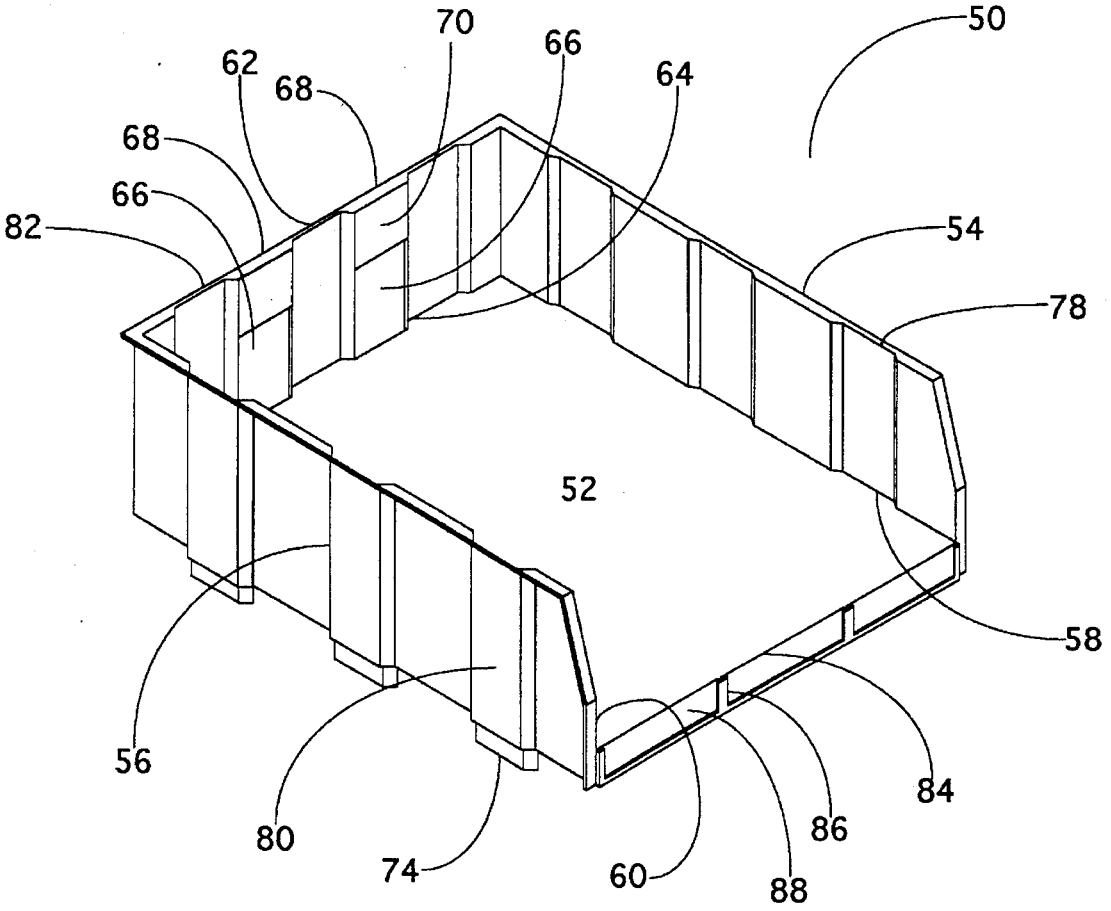
FIG. 7 is a perspective view of a sandpaper tray of the present invention.
Figure 9:
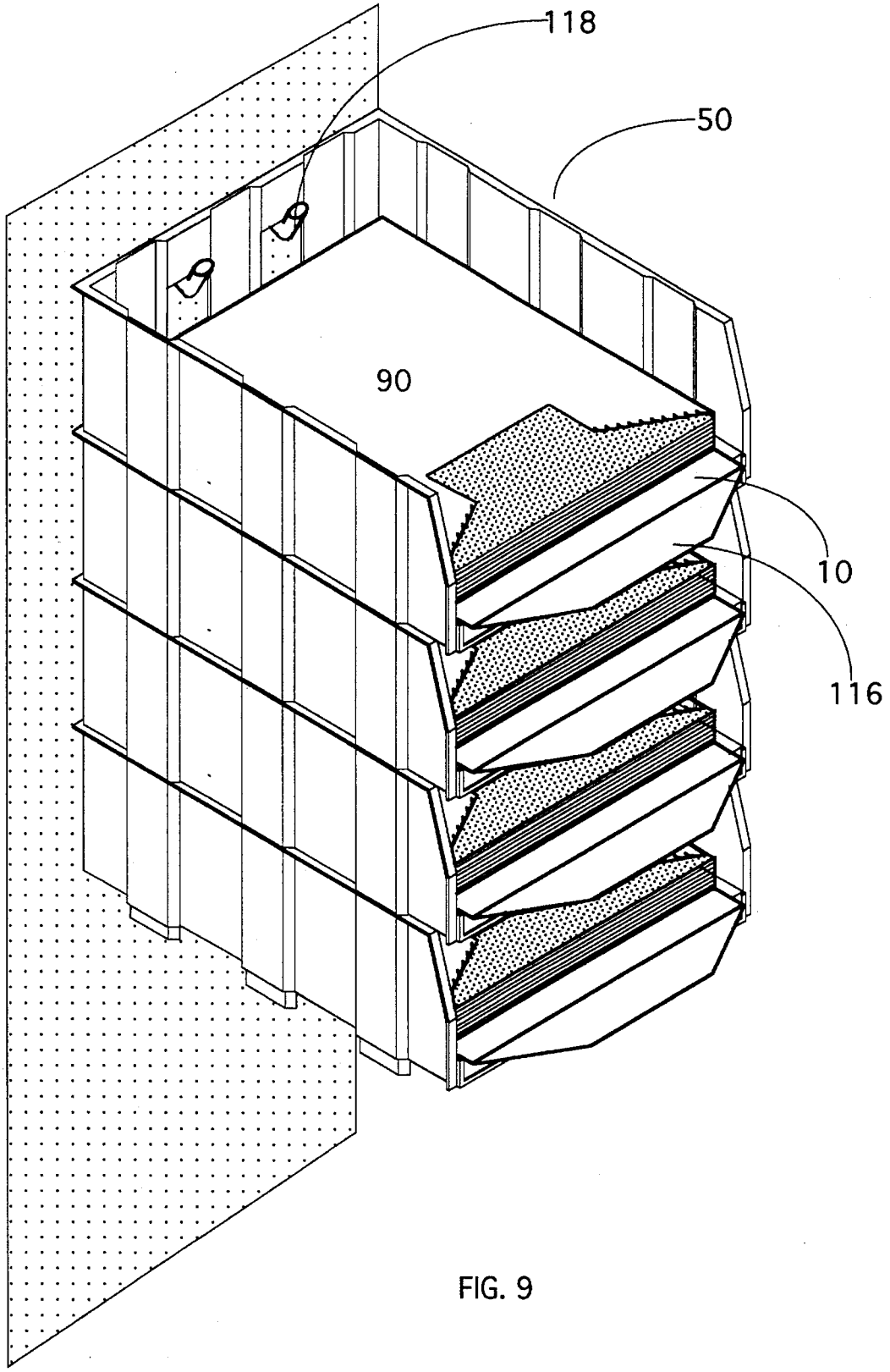
FIG. 9 is a perspective view showing single sheet sandpaper delivery system of the present invention.

The present invention employs a stackable tray 50 as shown in FIG. 7 and FIG. 9 of the system to address this problem. The tray 50 has a support surface 52 and sides 54 and 56 connected to edges 58 and 60, respectively, of surface 52. Each side 54 and 56 has an alternating ribbed construction to lend support for stacking. A back side 62 is connected to a back edge 64 of the surface 52 and interconnects sides 54 and 56. Back side 62 is formed with similar ribbed construction to lend further support for stackability. The back side 62 has openings 66 defined in ribbed section 68 of the side 62. Openings 66 permit hooks or the like to be inserted therethrough to grasp an upper portion 70 of the sections 68. It is contemplated that the back side 62 could be alternatively formed with peg hooks or the like for hanging the tray 50 from a peg board, for example.

Each of the sides 54, 56 and 62 has legs 72 (not shown), 74 and 76 (not shown), respectively, extending downwardly from ribbed sections 78, 80 and 82, respectively. Legs 72, 74 and 76 are recessed inwardly from an outer surface of sections 78, 80 and 82, respectively, to aid in stackability of the tray 50.

A front edge 84 of the surface 52 is formed with a lower extending lip 86 having slotted surface 88 formed therein to receive an identifying plate for indicating a type of grit sandpaper or the like.

Figure 8:
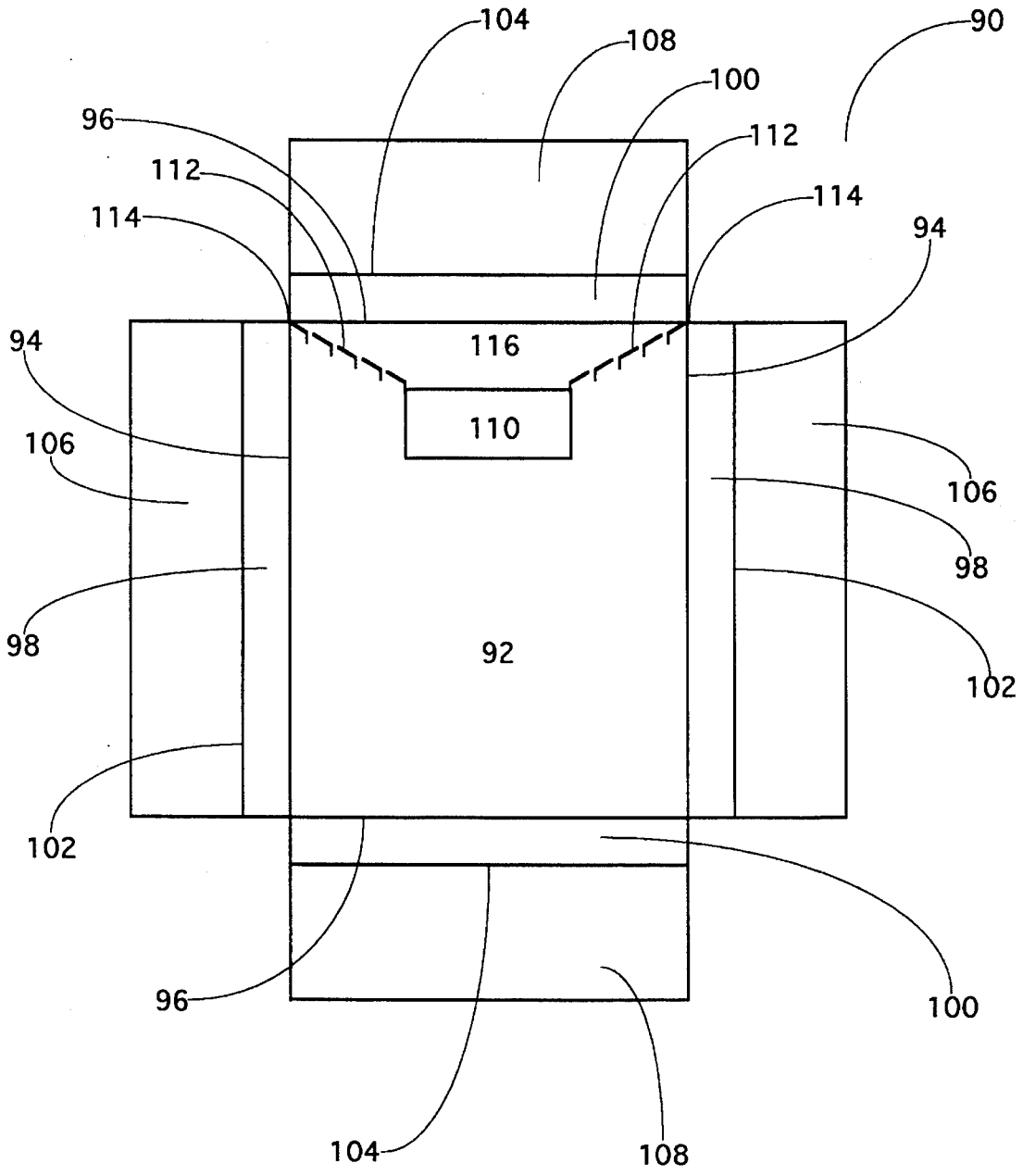
FIG. 8 is a plan view of the package of the present invention.

FIG. 8 shows a plan view of package 90 of the present invention in a preformed state. The package 90 has a first housing portion 92 of a size and configuration slightly less than the surface 52. Bendably attached to edges 94 and 96 are flaps 98 and 100, respectively. Flaps 98 and 100 are of a length of between about ⅛" to ⅝" measured from edges 94 and 96 to edges 102 and 104, respectively. Also, bendably attached to flaps 98 and 100 are terminating flap 106 and 108, respectively. Flaps 106 and 108 are of a length and configuration such that when the flaps 98 and 100 are bent in a common direction generally normal to the portion 92, the flaps 106 and 108 are bendable inwardly toward one another generally parallel to the portion 92. The flaps 108 and 106 are adhesively or otherwise bonded together as is known in the art to form a package for housing multiple sandpaper sheets 10. When bonded, the package 90 is preferably designed to hold about 15 to 25 sandpaper sheets 10 depending upon the grit size in a manner which precludes substantial curling as the sheets 10 are removed.

The housing portion 92 has an opening 110 defined at one end and further includes zipper perforations 112 which extend diagonally inwardly from corners 114 of a predetermined distance and terminate into the opening 110.

The sheets 10 are placed grit-side down on the portion 92 such that the grit 14 can be viewed through the opening 110 when the package is sealed. Once the sheets 10 are loaded and housed in the packages 90, the packages are placed in trays 50 in a manner shown in FIG. 9. The packages 90 can be readily opened by pulling away the zipper flap 116 from the housing portion 92. The remaining housing portion 92 and flaps 96, 98, 106 and 108 keep the sheets 10 from curling to allow the consumer easy inspection thereof.

FIG. 9 also displays the system in a contemplated mode of operation, wherein each tray 50 may be suspended by hooks 118 or the like and stacked in a horizontal manner for maximum use of showroom square footage.

While a preferred embodiment has been set forth above, it is intended only to present the invention in an embodiment. It will be readily apparent to those skilled in the art that many obvious modifications, derivations, and improvements exist and are intended to be included within the scope of the invention and appended claims hereto.

What is claimed is:

1. A sandpaper sheet comprising:

a substrate having a first side of sufficient porosity to maintain a coat of adhesive material and a second side sufficiently nonporous to accept a printed ink bar code with minimal diffusion to provide an overall improved and readable bar code;

a base adhesive coat substantially covering and penetrating said first side of said substrate;

an abrasive grit material dispersed over and bonded to said base adhesive coat and said first side of said substrate; and an ink printed bar code on said second side of said substrate, wherein said ink is of a high solids content and high dry weight.

2. The sandpaper sheet of claim 1, wherein said substrate is further characterized to be of a bleached kraft paper.

3. The sandpaper sheet of claim 1, wherein said substrate is of a bleached upgrade cabinet paper.

4. The sandpaper sheet of claim 1, wherein said substrate is a waterproof latex paper material and said base adhesive includes an amount of opacifier necessary to increase bar code readability without substantially affecting integrity of said sandpaper sheet.

5. A sandpaper sheet having an ink bar coding printed thereon with an overall acceptable and readable scan analysis profile wherein said sheet is made of:

a paper selected from one of kraft and an upgrade cabinet paper with at least one side supercalendered to cause sufficient closure of porosity of said side and provide said side with a surface smoothness of about 200– 300 ml/min. Bendtsen (Scan-P21:67) to provide a paper substrate having one surface suitable for printing a readable bar code thereon and leaving another surface sufficiently porous to readily and effectively adhere an adhesive and grit thereto;

said supercalendered side of said sheet having an ink printed bar code thereon comprised of a high solids and high solvent contents ink;

another side of said sheet comprised of an adhesive material, with an abrasive grit applied to said adhesive material, which is cured with said ink printed bar code thereon to provide said bar coded sandpaper sheet.

6. The sandpaper sheet of claim 5, wherein said sheet is further characterized to include a resin sizing coat applied subsequently to the step of drying and further includes another step of drying said resin sized sheet.

* * * * *